US010618071B2

(12) United States Patent
Christ et al.

(10) Patent No.: US 10,618,071 B2
(45) Date of Patent: Apr. 14, 2020

(54) DISCHARGING DEVICE FOR THE DISCHARGE OF LIQUID MEDIA

(71) Applicant: AERO PUMP GMBH, Hochheim/Main (DE)

(72) Inventors: Stefan Christ, Hochheim/Main (DE); Andreas Mersmann, Frankfurt am Main (DE)

(73) Assignee: AERO PUMP GMBH, Hochheim/Main (DE)

( * ) Notice: Subject to any disclaimer, the term of this patent is extended or adjusted under 35 U.S.C. 154(b) by 0 days.

(21) Appl. No.: 16/242,499

(22) Filed: Jan. 8, 2019

(65) Prior Publication Data

US 2019/0210049 A1 Jul. 11, 2019

(30) Foreign Application Priority Data

Jan. 9, 2018 (DE) ..... 10 2018 100 338

(51) Int. Cl.
*B05B 11/00* (2006.01)

(52) U.S. Cl.
CPC ..... *B05B 11/3001* (2013.01); *B05B 11/3002* (2013.01); *B05B 11/307* (2013.01); *B05B 11/3015* (2013.01); *B05B 11/3052* (2013.01); *B05B 11/0067* (2013.01); *B05B 11/305* (2013.01); *B05B 11/3074* (2013.01)

(58) Field of Classification Search
CPC ..... B05B 11/3001; B05B 11/3002; B05B 11/3015; B05B 11/3052; B05B 11/307; B05B 11/0067; B05B 11/305; B05B 11/3074
USPC ..... 222/383.1, 321.2, 321.7–321.9, 402, 222/403.13, 402.25
See application file for complete search history.

(56) References Cited

U.S. PATENT DOCUMENTS 4,262,823 A * 4/1981 Monden ..... B05B 11/3019 222/321.9
4,361,255 A * 11/1982 Saito ..... B05B 11/304 222/321.2
4,462,549 A * 7/1984 Saito ..... B05B 11/3016 222/321.2
4,728,008 A 3/1988 Graf et al.
(Continued)

FOREIGN PATENT DOCUMENTS

DE 2837355 3/1979
DE 35 30 486 3/1987
(Continued)

OTHER PUBLICATIONS

Europe Office Action conducted in counterpart Europe Appl. No. 18204255.6 (dated May 3, 2019) (w/ Partial machine translation).
(Continued)

*Primary Examiner* — Lien M Ngo
(74) *Attorney, Agent, or Firm* — Greenblum & Bernstein, P.L.C.

(57) ABSTRACT

A discharging device for the discharge of liquid media is specified, with a pump chamber that comprises an inlet opening and an outlet opening, and with a piston that is displaceable in the pump chamber. The object is to be able to dispense a medium with high accuracy using the discharging device. For this purpose, the piston comprises a projection which enters the inlet opening after a predetermined stroke of the piston.

19 Claims, 3 Drawing Sheets

(56) References Cited

U.S. PATENT DOCUMENTS

| | | | | |
|---|---|---|---|---|
| 5,687,883 | A * | 11/1997 | Su | B05B 11/3018 222/321.2 |
| 6,244,472 | B1 * | 6/2001 | Hennemann | B05B 11/00444 222/189.09 |
| 6,626,332 | B2 * | 9/2003 | Ehrensperger | A47K 5/14 222/1 |
| 6,726,064 | B2 * | 4/2004 | Bonningue | B05B 11/3001 222/321.9 |
| 7,040,511 | B1 * | 5/2006 | Petit | B05B 11/3047 222/321.2 |
| 7,172,097 | B2 * | 2/2007 | Petit | B05B 11/3019 222/189.09 |
| 2002/0134799 | A1 * | 9/2002 | Su | B05B 11/3023 222/321.2 |
| 2003/0197031 | A1 * | 10/2003 | Petit | B05B 11/3018 222/321.9 |
| 2005/0023300 | A1 | 2/2005 | Schultz | |
| 2006/0027607 | A1 | 2/2006 | Schultz | |

FOREIGN PATENT DOCUMENTS

| | | |
|---|---|---|
| DE | 60 2004 008340 | 5/2008 |
| GB | 1172306 | 11/1969 |
| WO | 02/094708 | 11/2002 |

OTHER PUBLICATIONS

German Office Action conducted in counterpart German Appl. No. 10 2018 100 338.2(dated Aug. 23, 2018) (w/ Partial machine translation).

* cited by examiner

DISCHARGING DEVICE FOR THE DISCHARGE OF LIQUID MEDIA

CROSS-REFERENCE TO RELATED APPLICATION

The present application claims priority under 35 U.S.C. § 119 of German Patent Application No. 10 2018 100 338.2, filed Jan. 9, 2018, the disclosure of which is expressly incorporated by reference herein in its entirety.

BACKGROUND OF THE EMBODIMENTS

1. Field of the Invention

Embodiments relate to a discharging device for the discharge of liquid media with a pump chamber that comprises an inlet opening and at least one outlet opening and with a piston that is displaceable in the pump chamber.

2. Discussion of Background Information

A discharging device of this type is used, for example, to discharge a dose of a medication which is present in liquid form. For this purpose, the medium can be atomized, for example, as in the case of a nasal spray or a throat spray.

For the discharge of the medium, the piston, which for this purpose is normally connected to a knob, is displaced in the pump chamber. As a result, the volume of the pump chamber is reduced. The medium is pumped out of the pump chamber through the outlet opening and ultimately dispensed out of the device in the amount by which the volume is reduced. In a return stroke of the piston, the volume of the pump chamber is increased again. The medium can then flow into the pump chamber through the inlet opening, so that the pump chamber is filled again for the next actuation stroke of the piston.

The arrangement of the inlet opening in a side wall of the pump chamber is known. In this case, the inlet opening is closed off during a piston stroke in the discharge direction and cleared again in a return stroke.

In many cases, the ability to dispense an amount of the medium dosed as exactly as possible with the discharging device is desired.

SUMMARY

Accordingly, embodiments of the invention enable an exact dosage of a dispensing amount of the medium.

In embodiments, a discharging device of the type named at the outset includes the piston having a projection which enters the inlet opening after a predetermined stroke of the piston.

The predetermined stroke of the piston can be relatively small. The projection then already enters the inlet opening shortly after the start of the stroke. When the projection enters the inlet opening, the inlet opening is immediately closed off, as a result of which no medium can be pumped out of the pump chamber through the inlet opening. The start of a discharge stroke is thus very precisely defined. If the start of a discharge stroke is clearly defined, the amount of the discharged medium can be dosed in a relatively exact manner.

In this case, it is preferred that the inlet opening is undersized compared to a cross section of the projection. The inlet opening must therefore widen slightly when the projection enters thereinto. However, this is normally possible without a problem when plastic materials are used, without the need for a user to apply larger forces in this case. If the inlet opening is undersized, a good seal is created at the moment when the projection enters the inlet opening, with which seal the medium is prevented from being able to escape from the pump chamber through the inlet opening.

Preferably, the inlet opening comprises a sealing lip that interacts with the projection. A sealing lip ensures a leak tightness in a simple manner.

Preferably, the at least one outlet opening is connected to a pressure-controlled outlet valve, and the piston connects the outlet opening to a low-pressure region at the end of a discharge stroke. A pressure-controlled outlet valve opens when a first predetermined pressure is exceeded on the inlet side of the valve and closes when the pressure falls below a predetermined pressure on the inlet side of the valve. The first pressure and the second pressure can be equal. However, they can also be different. If the piston connects the outlet opening or outlet openings to a low-pressure region at the end of the discharge stroke, then the pressure at the inlet of the outlet valve drops and the outlet valve closes again. In this manner, both the start and also the end of the dispensing of the medium are clearly defined, so that a very precise dosing of the amount of the medium can be achieved.

In this case, it is preferred that the piston comprises an enlargement region tapering in a direction away from the inlet opening, which enlargement region bears with the largest outer diameter thereof against an inner wall of the pump chamber and, at the end of the discharge stroke, has been moved at least past a portion of the at least one outlet opening or enters a discharge chamber with a larger diameter, which chamber is connected to the outlet opening. The enlargement region can, for example, have the shape of a cone that is also provided with a sealing lip in the region of the largest diameter of the cone. Once the sealing lip has swept past a portion of the outlet opening(s), there is a connection between the outlet opening(s) and a low-pressure region on the radial outer side of the enlargement region. The low-pressure region can, for example, be connected to the interior of a reservoir in which the medium that is to be dispensed is present. Alternatively, the enlargement region can also enter a discharge chamber that is connected to the outlet opening(s). The discharge chamber has a larger diameter than the enlargement region of the piston, so that the circumference of the enlargement region no longer bears against the inner wall of the pump chamber. The outlet opening(s) and the low-pressure region can also be connected to one another in this manner.

Preferably, the piston is guided in a housing section, wherein an air supply path is embodied between the piston and the housing section. If the medium has been pumped out of the pump chamber and new medium is suctioned out of the reservoir into the pump chamber, a negative pressure occurs in the reservoir, which negative pressure must be compensated. For this purpose, air can enter the reservoir via the air supply path between the piston and the housing section. The air supply path between the piston and the housing section is the only air supply path in the present case. The discharging device is otherwise embodied to be airtight. Through the use of a single air supply path, the air flow that is used for the pressure compensation can be controlled in a relatively exact manner.

Preferably, the housing section forms at an inner end of the air supply path a valve seat, against which a valve element that is embodied on the piston or is connected to the piston bears in a non-actuated state of the piston. Thus, when the piston is in the non-actuated state, in which the pump chamber has its largest volume, the air supply path is closed off. This has two effects. On the one hand, no more air can enter the reservoir to which the discharging device is connected. The risk of a contamination of the contents of the reservoir is thus minimized. On the other hand, a lock is also present which prevents the medium from escaping out of the reservoir through the discharging device. This is particularly advantageous where the discharging device is intended for an "upside down" dispensing, in which the reservoir is located above the discharging device in the direction of gravity.

Preferably, the air supply path passes through a filter arrangement. The filter arrangement can, for example, be formed by a filter matrix. The filter matrix filters the incoming air for germs and prevents a contamination of the system. The filter matrix can also contain biologically active substances which have a germicidal or germ-reducing effect, for example silver.

Preferably, the air supply path is connected to at least one air supply opening, and the inlet opening is connected to an inlet channel, wherein the at least one air supply opening is, on the side thereof facing away from the air supply path, separated from the inlet channel by a partition wall. The inlet channel is provided in order to conduct the medium from the reservoir to the inlet opening. The air supply opening or air supply openings are provided in order to allow air into the reservoir for the pressure compensation. By means of the partition wall, it is ensured that the incoming air does not immediately mix with the liquid entering the pump chamber. The liquid entering the pump chamber can thus be kept free of bubbles.

Preferably, the piston has a movement direction that is directed at an angle in the range of 60° to 120°, in particular at an angle of 90°, to a dispensing direction for the medium. This results in easy handling. A user can operate a knob, which actuates the piston, wherein the operational direction is directed perpendicularly or approximately perpendicularly to the dispensing direction.

Embodiments are directed to a discharging device for the discharge of liquid media that includes a pump chamber having an inlet opening and at least one outlet opening and a piston that is displaceable in the pump chamber. The piston includes a projection which enters the inlet opening after a predetermined stroke of the piston.

According to embodiments, the inlet opening can be undersized as compared to a cross section of the projection.

In accordance with embodiments, the inlet opening may include a sealing lip that interacts with the projection.

According to other embodiments, the at least one outlet opening can be connected to a pressure-controlled outlet valve and the piston connects the outlet opening to a low-pressure region at the end of a discharge stroke. Further, the piston may include an enlargement region tapering in a direction away from the inlet opening. The enlargement region can having a largest outer diameter configured to bear against an inner wall of the pump chamber, and the enlargement region may be movable so that, at the end of the discharge stroke, the enlargement region is positionable past at least a portion of the at least one outlet opening or to have entered a discharge chamber, which is connected to the at least one outlet opening, with a diameter larger than the largest outer diameter of the enlargement region.

In further embodiments, the discharging device can include a housing section. The piston may be guided in the housing section, and an air supply path can be embodied between the piston and the housing section. Further, the housing section forms a valve seat at an inner end of the air supply path, and a valve element can be embodied on or connected to the piston is arranged so that, in a non-actuated state of the piston, the valve element bears against the valve seat. The discharging device can also include a filter arrangement positioned so that the air supply path passes through the filter arrangement. The discharge device can also include a partition wall. The air supply path may be connected to at least one air supply opening, and the inlet opening can be connected to an inlet channel, and the partition wall can be arranged to separate the at least one air supply opening, on a side facing away from the air supply path, from the inlet channel.

According to still other embodiments, the piston can be movable in a movement direction oriented at an angle in the range of 600 to 120° relative to a dispensing direction for the medium.

Embodiments are directed to a method for discharging liquid media from the above-described embodiments of the discharging device. The method includes displacing the piston in the pump chamber. After a predetermined stroke of the piston, the projection of the piston enters the inlet opening.

According to embodiments, after a full discharge stroke of the piston, a predefined dose of the liquid media is dispensed through a nozzle, wherein most of the full discharge stroke of the piston occurs after the projection enters the inlet opening. Further, during the full discharge stroke following the projection entering the inlet opening, the method further can include opening a pressure controlled outlet valve to supply the predefined dose to the nozzle. Further, at an end of the full discharge stroke, the method can further include connecting the at least one outlet opening to a low pressure region, whereby the pressure controlled outlet valve is closed.

In accordance with still other embodiments, the method, after the projection enters the inlet opening, can also include forming a seal between the inlet opening and the projection.

Embodiments are directed to a method for discharging liquid media from a discharging device. The method includes inserting a projection of a piston into an inlet opening of a pump chamber of the discharging device after a predetermined stroke of the pump piston that is less than a full discharge stroke of the piston that discharges a predefined dose of the liquid media through a nozzle of the discharging device.

According to embodiments, most of the full discharge stroke of the piston occurs after the inserting of the projection into the inlet opening. Moreover, after inserting the projection into the inlet opening, the method can also include sealing the inlet opening against the projection.

In accordance with still yet other embodiments, the discharge device can include a pressure controlled outlet valve arranged to supply the liquid media to the nozzle, and the pump chamber may include at least one outlet opening. Between the inserting of the projection and an end of the full discharge stroke of the piston, the pressure controlled outlet valve may be opened to supply the liquid media to the nozzle. Further, after at the end of the full discharge stroke of the piston, the at least one outlet may be connected to a low pressure region so that the pressure controlled valve is closed to stop the supply of the liquid media to the nozzle.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
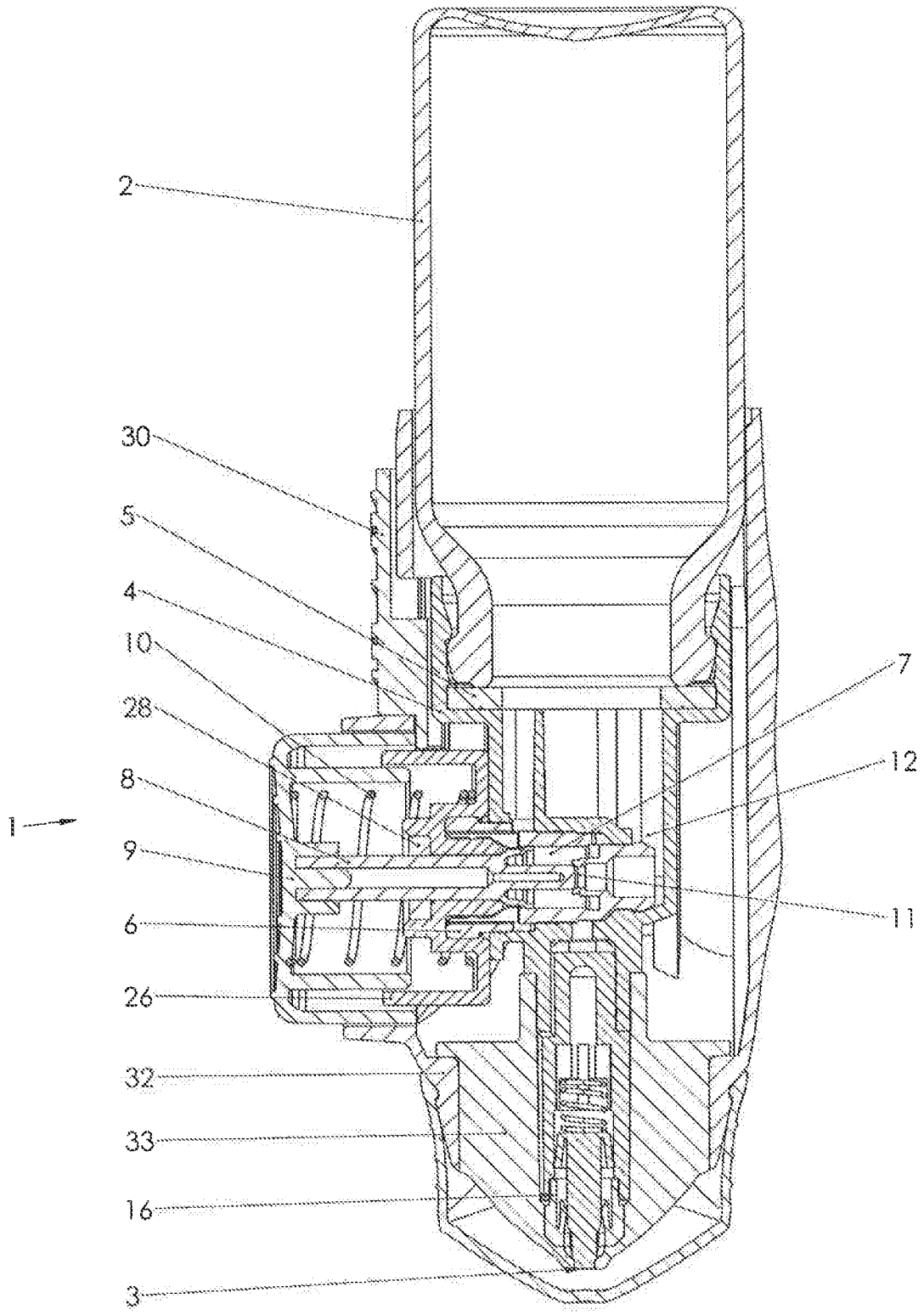
FIG. 1 shows a schematic sectional view of a discharging device.

FIG. 1 shows a discharging device 1 that is connected to a reservoir 2. The reservoir 2 can be filled with a liquid medium that is to be dispensed through a dispensing nozzle (or outlet opening) 3. For the sake of clarity, the medium is not illustrated.

The discharging device 1 comprises a housing 4 that is snapped onto the reservoir 2 or attached to the reservoir 2 in another manner. A seal 5 is arranged between the housing 4 and the reservoir 2.

In the housing 4, a pump housing 6 that encloses a pump chamber 7 is arranged. In the pump chamber 7, a piston 8 is arranged that can be actuated against the force of a spring 10 via a knob 9. During the actuation, the piston 8 is moved into the pump chamber 7 and thus reduces the volume of the pump chamber 7.

The pump chamber 7 comprises an inlet opening 11 that is connected to an inlet channel 12. The inlet channel 12 produces a connection between the reservoir 2 and the inlet opening 11.

Figure 2:
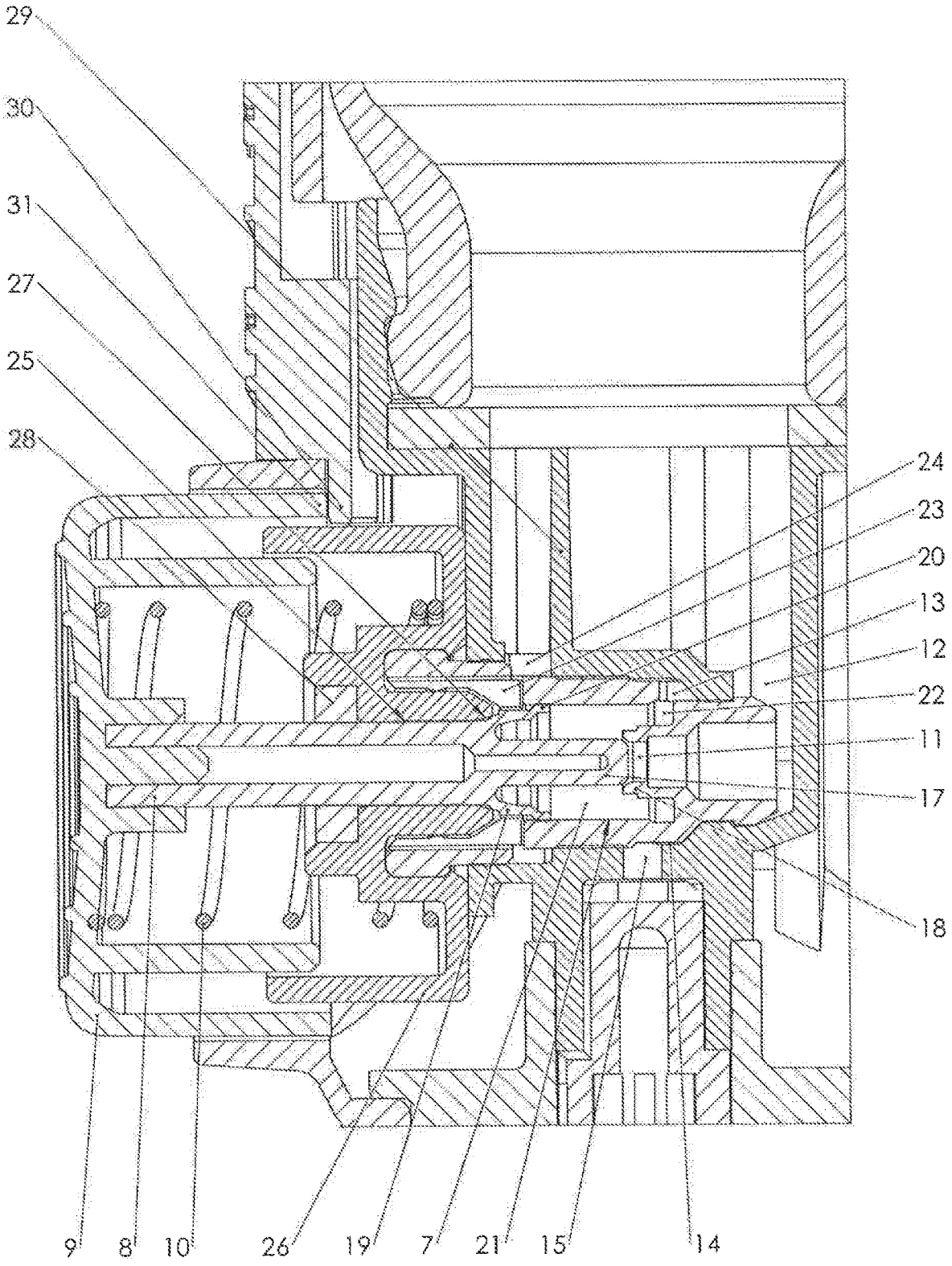
FIG. 2 shows an enlarged partial view of the discharging device in the non-actuated state.

Furthermore, as shown with more detail in FIG. 2, the pump chamber 7 comprises at least one outlet opening 13 which ends in an annular space 14 that is connected to an outlet channel 15. The outlet channel 15 then leads to a pressure-controlled outlet valve 16. The outlet valve 16 controls the dispensing of the medium through the outlet opening 3. Outlet valve 16 opens at a predetermined first pressure on its inlet side, that is, in the outlet channel 15, and closes at a predetermined second pressure in the outlet channel 15. The two pressures can be equal, but do not need to be.

The piston 8 comprises a projection 17 which enters the inlet opening 11 shortly after the start of a movement in the direction of the inlet opening 11. A movement of the piston 8 out of its non-actuated or resting position illustrated in FIG. 2 is hereinafter referred to as a "discharge stroke." The projection 17 of the piston 8 thus closes off the inlet opening 11 shortly after the start of the discharge stroke. At the start of the discharge stroke, however, a gap is present between the projection 17 and the inlet opening 11. The inlet opening 11 is somewhat smaller than the cross section of the projection 17, that is, the inlet opening 11 is undersized compared to the cross section of the projection 17. For this purpose, the inlet opening 11 is provided with a sealing lip 18. The sealing lip 18 bears against the projection 17 in a sealing manner during a movement of the projection 17 into the inlet opening 11. With the entry of the projection 17 into the inlet opening 11, there results a clearly defined closing-off of the inlet opening 11, and therefore a clearly defined moment at which a pumping of the medium located in the pump chamber 7 out through the outlet opening 13 begins during a further movement of the piston 8 into the pump chamber 7.

Because the medium is normally incompressible, the corresponding pressure increase also occurs with the start of the pumping of the medium out of the pump chamber 7, which pressure increase leads to an opening of the outlet valve 16.

Figure 3:
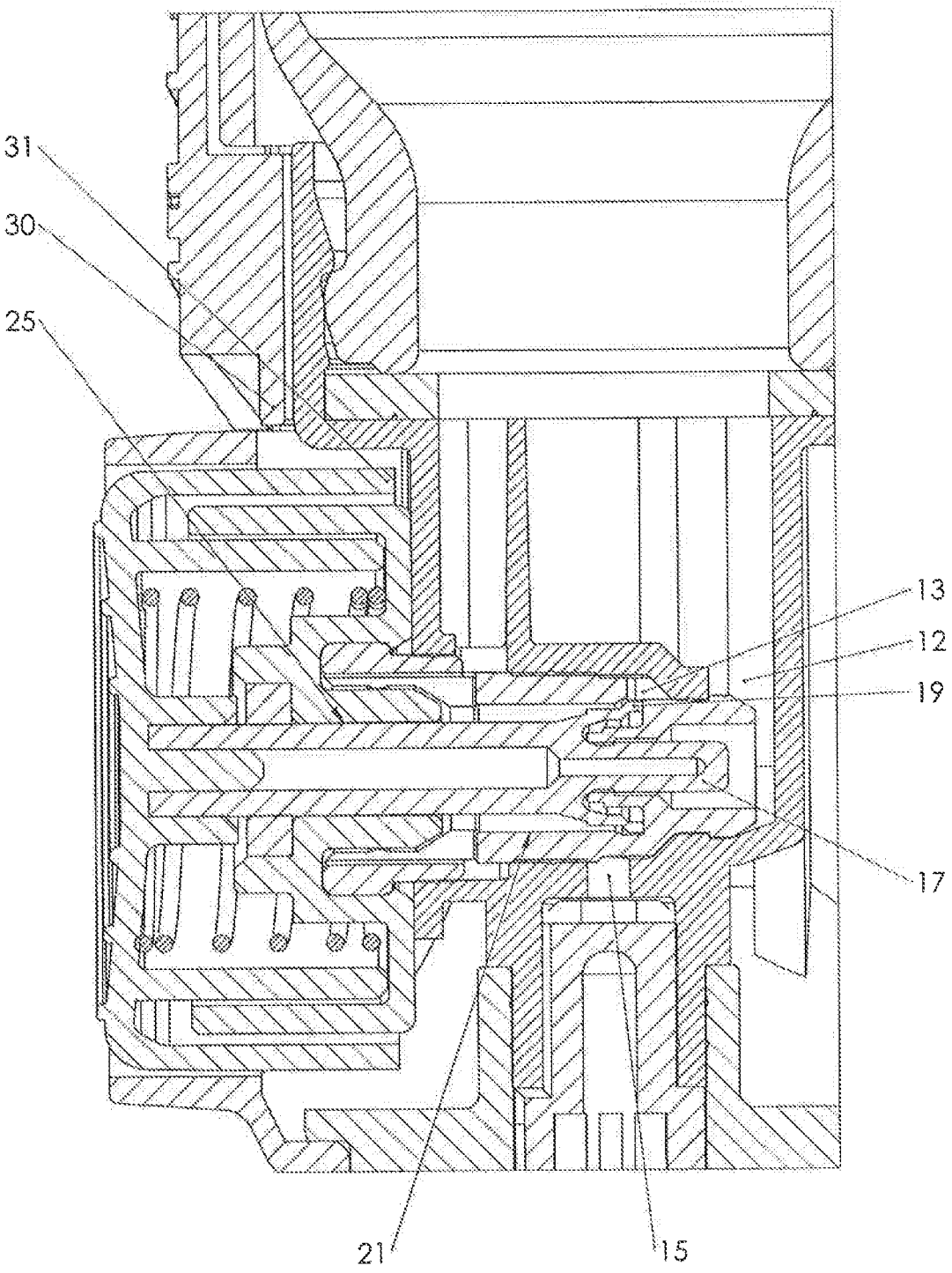
FIG. 3 shows an enlarged partial view of the discharging device in the actuated state.

The piston 8 comprises an enlargement region 19 which tapers in a direction away from the inlet opening 11. The enlargement region 19 can also be simply referred to as a "cone," although a conical shape is not mandatory. The enlargement region 19 bears with the largest diameter 20 thereof against an inner wall 21 of the pump chamber 7. At the end of the discharge stroke (see FIG. 3), the largest diameter 20 enters a discharge chamber 22, which has a larger diameter than the pump chamber 7 and is connected to the outlet opening or the outlet openings 13. At this moment, the largest diameter 20 no longer bears against the inner wall of the pump chamber 7, as a result of which a connection is produced between the outlet opening 13 and a low-pressure region. Alternatively, the largest diameter 20 at least partially clears the outlet opening 13, that is, the enlargement region has been moved at least partially past the outlet opening 13. The outlet opening 13 is also connected to the low-pressure region in this manner. The pressure in the outlet channel 15 thus abruptly falls to the pressure in the low-pressure region. The outlet valve 16 closes. Because the closing pressure of the outlet valve 16, and thus the moment of closing, is also determined by the position of the piston 8 in the pump chamber 7, the volume of the medium dispensed through the outlet opening 3 can be dosed in a very exact manner.

The low-pressure region comprises at least one air supply opening 23 in the pump chamber housing 6, which opening is connected to an air supply channel 24 in the housing 4. A pressure that is equal to the pressure in the interior of the tank 2 is thus present in the air supply channel 24 and in the air supply opening 23. This pressure is significantly lower than a pressure that is present in the pump chamber 7 during a discharge stroke of the piston 8.

If the piston is moved back into its initial position or resting position under the influence of the spring 10 after completion of a discharge stroke, the projection 17 also moves out of the inlet opening 11. With the return movement of the piston 8, a negative pressure occurs in the pump chamber 7, so that medium from the reservoir 2 can enter the pump chamber 7 through the inlet channel 12 and the inlet opening 11 once a gap has formed again between the projection 17 and the sealing lip 18. In order to then produce a pressure compensation in the reservoir 2, an air supply path 25 is provided between the piston 8 and a housing section 26 in which the piston is positioned. The air supply path 25 is the only connection between the interior of the reservoir 2 and the surrounding environment.

A filter arrangement 28 surrounds the piston 8. Accordingly, the air supply path 25 passes through the filter arrangement 28.

At the end of the air supply path 25 that faces the inlet opening 11, the housing section 26 comprises a valve seat 27, against which a valve element that is embodied on the piston 8 or is connected to the piston 8 bears in a non-actuated state of the piston 8.

In the present case, the valve element is formed by a region of the diameter enlargement 19 facing away from the inlet opening 11. Thus, in the non-actuated state of the piston 8, no more air enters the reservoir 2, so that the risk of a contamination of the contents of the reservoir 2 is minimized. Furthermore, the bearing of the diameter enlargement 19 against the valve seat 27 prevents liquid from being able to escape outside from the reservoir 2.

The air supply opening or air supply openings 23 and the inlet channel 12 are separated from one another by a partition wall 29 on the side of the housing 4 facing the reservoir 2. Air that enters the discharging device 1 through the air supply path 25 therefore cannot mix with the liquid medium that is present in the inlet channel 12 and will shortly be suctioned into the pump chamber 7. A bubble-free filling of the pump chamber 7 can thus be achieved.

A locking slider 30 is provided which can be slid under a bottom edge 31 of the knob 9 in order to prevent an actuation of the knob 9. The disabling of the knob 9 is reversible, however.

Furthermore, the discharging device can comprise an outer sleeve 32 which secures a head 33 to the housing 4.

The discharging device is in particular suitable for an "upside down" dispensing of the medium from the reservoir 2, that is, for a situation in which the reservoir 2 is arranged above the discharging device 1 in the direction of gravity.

The piston 8 is arranged transversely to a dispensing direction for the medium and is movable, that is, the piston 8 forms an angle in the range of 60° to 120°, preferably about 90°, with a dispensing direction.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A discharging device for the discharge of liquid media contained in a tank, comprising:

a pump chamber having an inlet opening and at least one outlet opening;

a piston that is displaceable in the pump chamber, wherein the piston comprises a projection which enters the inlet opening after a predetermined stroke of the piston, wherein the at least one outlet opening is connected to a pressure-controlled outlet valve, and wherein, at an end of a discharge stroke of the piston, which includes the predetermined stroke, the piston connects the at least one outlet opening to a low-pressure region, which has a pressure equal to a pressure in the tank.

2. The discharging device according to claim 1, wherein the inlet opening is undersized as compared to a cross section of the projection.

3. The discharging device according to one of claim 1, wherein the inlet opening comprises a sealing lip that interacts with the projection.

4. The discharging device according to claim 1, wherein the piston comprises an enlargement region tapering in a direction away from the inlet opening, the enlargement region having a largest outer diameter configured to bear against an inner wall of the pump chamber, and wherein the enlargement region is movable so that, at the end of the discharge stroke, the enlargement region is positionable past at least a portion of the at least one outlet opening or to have entered a discharge chamber, which is connected to the at least one outlet opening, with a diameter larger than the largest outer diameter of the enlargement region.

5. The discharging device according to claim 1, further comprising a housing section, wherein the piston is guided in the housing section, and an air supply path is embodied between the piston and the housing section.

6. The discharging device according to claim 5, wherein the housing section forms a valve seat at an inner end of the air supply path, and wherein a valve element is embodied on or connected to the piston is arranged so that, in a non-actuated state of the piston, the valve element bears against the valve seat.

7. The discharging device according to claim 5, further comprising a filter arrangement positioned so that the air supply path passes through the filter arrangement.

8. The discharging device according to claim 5, further comprising a partition wall, wherein the air supply path is connected to at least one air supply opening, and the inlet opening is connected to an inlet channel, and wherein the partition wall is arranged to separate the at least one air supply opening, on a side facing away from the air supply path, from the inlet channel.

9. The discharging device according to claim 1, wherein the piston is movable in a movement direction oriented at an angle in the range of 60° to 120° relative to a dispensing direction for the medium.

10. A method for discharging liquid media from the discharging device according to claim 1, the method comprising:

displacing the piston in the pump chamber, wherein, after a predetermined stroke of the piston, the projection of the piston enters the inlet opening.

11. The method according to claim 10, wherein, after a full discharge stroke of the piston, a predefined dose of the liquid media is dispensed through a nozzle, and wherein most of the full discharge stroke of the piston occurs after the projection enters the inlet opening.

12. The method according to claim 11, wherein, during the full discharge stroke following the projection entering the inlet opening, the method further comprises opening a pressure controlled outlet valve to supply the predefined dose to the nozzle.

13. The method according to claim 12, wherein, at an end of the full discharge stroke, connecting the at least one outlet opening to a low pressure region, whereby the pressure controlled outlet valve is closed.

14. The method according to claim 10, further comprising, after the projection enters the inlet opening, forming a seal between the inlet opening and the projection.

15. A method for discharging liquid media contained in a tank from a discharging device, the method comprising:

inserting a projection of a piston into an inlet opening of a pump chamber of the discharging device after a predetermined stroke of the piston that is less than a full discharge stroke of the piston that discharges, via a pressure controlled outlet valve, a predefined dose of the liquid media through a nozzle of the discharging device, wherein at least one outlet opening of the pump chamber is connected to the pressure controlled outlet valve and at an end of the full discharge stroke of the piston, connecting the at least one outlet opening to a low-pressure region, which has a pressure equal to a pressure in the tank.

16. The method according to claim 15, wherein most of the full discharge stroke of the piston occurs after the inserting of the projection into the inlet opening.

17. The method according to claim 15, further comprising, after inserting the projection into the inlet opening, sealing the inlet opening against the projection.

18. The method according to claim 12, wherein the discharge device includes a pressure controlled outlet valve arranged to supply the liquid media to the nozzle, and the pump chamber comprises at least one outlet opening; and wherein, between the inserting of the projection and an end of the full discharge stroke of the piston, the pressure controlled outlet valve is opened to supply the liquid media to the nozzle.

19. The method according to claim 18, further comprising, after at the end of the full discharge stroke of the piston, the at least one outlet is connected to a low pressure region so that the pressure controlled valve is closed to stop the supply of the liquid media to the nozzle.

* * * * *